US005492786A

United States Patent [19]

Sugimura et al.

[11] Patent Number: 5,492,786

[45] Date of Patent: Feb. 20, 1996

[54] ELECTROPHOTOGRAPHIC PHOTORECEPTOR

[75] Inventors: Hiroshi Sugimura, Habikino; Satoshi Katayama, Nara; Kazushige Morita, Shiki; Yoshimi Kojima, Nara; Yoshimasa Fujita, Tenri; Satoshi Nishigaki, Nara; Kazuhiro Emoto, Nagaokakyo, all of Japan

[73] Assignee: Sharp Kabushiki Kaisha, Osaka, Japan

[21] Appl. No.: 293,029

[22] Filed: Aug. 19, 1994

[30] Foreign Application Priority Data

Aug. 26, 1993 [JP] Japan ..... 5-211496

[51] Int. Cl.[6] ..... G03G 5/047; G03G 5/04

[52] U.S. Cl. ..... 430/59; 430/58; 430/83; 430/96

[58] Field of Search ..... 430/58, 59, 83, 430/96

[56] References Cited

U.S. PATENT DOCUMENTS

| | | | |
|---|---|---|---|
| 3,877,935 | 4/1975 | Regensburger | 430/58 |
| 5,069,993 | 12/1991 | Robinette et al. | 430/58 |
| 5,213,928 | 5/1993 | Yu | 430/66 |

FOREIGN PATENT DOCUMENTS

| | | |
|---|---|---|
| 49-15220 | 4/1974 | Japan . |
| 54-130936 | 11/1979 | Japan . |
| 55-42380 | 10/1980 | Japan . |
| 55-140849 | 11/1980 | Japan . |
| 57-5050 | 1/1982 | Japan . |
| 57-212453 | 12/1982 | Japan . |
| 59-53850 | 3/1984 | Japan . |
| 59-214035 | 12/1984 | Japan . |
| 1-234854 | 1/1989 | Japan . |
| 4-199154 | 7/1992 | Japan . |
| 6-83080 | 3/1994 | Japan . |
| 6-89038 | 3/1994 | Japan . |

*Primary Examiner*—Roland Martin
*Attorney, Agent, or Firm*—Nixon & Vanderhye

[57] ABSTRACT

The present invention is directed to an electrophotographic photoreceptor which is smooth without orange peel, inhibits the rise of a residual potential and the drop of a charged potential, and is excellent in stability even when it is repeatedly used.

The photoreceptor comprises a charge generation material, a charge transport material, a polyarylate having a polymerization degree of 10 to 5,000, a polycarbonate having a polymerization degree of 10 to 5,000, and a polydimethylsiloxane having a polymerization degree of 0 to 2,000.

12 Claims, 1 Drawing Sheet

ELECTROPHOTOGRAPHIC PHOTORECEPTOR

BACKGROUND OF THE INVENTION (i) Field of the Invention

The present invention relates to an electrophotographic photoreceptor having an excellent surface smoothness for use in various printing machines and copying machines.

(ii) Description of the Related Art

Electrophotographic photoreceptors which have now been put to practical use can be classified into an inorganic photoreceptor using an inorganic material and an organic photoreceptor using an organic material. Typical examples of the inorganic photoreceptor include a selenium-based photoreceptor comprising amorphous selenium (a-Se) or amorphous selenium arsenic (a-$As_2Se_3$), a photoreceptor obtained by dispersing a dyestuffsensitized zinc oxide (ZnO) or cadmium sulfide (CdS) in a binder resin, and a photoreceptor using amorphous silicon (a-Si).

However, among the above-mentioned inorganic photoreceptors, the selenium-based photoreceptor and the photoreceptor using cadmium sulfide are poor in heat resistance and storage stability. In addition, these photoreceptors contain materials which are harmful to humans, and so they cannot simply be discarded from the viewpoint of an environmental protection and must be collected under regulations. Furthermore, the above-mentioned zinc oxide-dispersed photoreceptor has a poor sensitivity and a low durability, and for this reason, it has scarcely been used nowadays. The above-mentioned amorphous silicon-based photoreceptor has features such as a high sensitivity and a high durability, but owing to its complex manufacturing process, it has a drawback such as the occurrence of image failure.

On the other hand, typical examples of the organic photoreceptor include a photoreceptor using charge transfer complexes of 2,4,7-trinitro-9-fluorenone (TNF) and polyvinylcarbazole (PVK), and double-layered photoconductive structures having a charge generation layer containing a charge generation material for generating a charge carrier at the time of light irradiation and a charge transport layer containing a charge transport material for receiving and transporting the charge carrier generated in the charge generation layer. The organic materials are more present than the inorganic materials, and the organic materials most suitable for the photoreceptor can be selected from a large number of the organic materials, whereby the photoreceptors having the excellent storage stability and no poison can be prepared at a low cost. In recent years, the organic photoreceptors are considered to be most important since durability thereof has been improved.

For the above-mentioned PVK-TNF charge transfer complex-based organic photoreceptor, various improvements have been made, but a sufficient sensitivity has not been attained so far. On the other hand, the above-mentioned function-separated type organic photoreceptors have a relatively excellent sensitivity, and so they occupy most of the organic photoreceptors which have now been put to practical use.

Known examples of such a function-separated type organic photoreceptors include a photoreceptor comprising a charge generation layer formed by applying an organic amine solution of chlorodiane blue and a charge transport layer containing a hydrazone compound (Japanese Patent Publication Sho 55 No. 42380), a photoreceptor comprising a charge generation layer containing a disazo compound and a charge transport layer containing a hydrazone compound (Japanese Patent Application Laid-open Sho 59 No. 214035), and a photoreceptor comprising a charge generation layer containing an azulenium salt compound and a charge transport layer containing a hydrazone compound (Japanese Patent Application Laid-open Sho 59 No. 53850). In addition, there has also been suggested a photoreceptor in which an anthanthrone or a quinone compound which is a kind of pigment is used as a charge generation material (U.S. Pat. No. 3877935).

Each of these organic photoreceptors can be prepared by forming a photoconductive layer on a sheet-like or a drum-like conductive support. As a method of forming the photoconductive layer on the sheet-like conductive support, there is known a method using a Baker applicator or a bar coater. For the sake of the drum-like support, there are known a spray method, a vertical ring method and an immersion coating method, and among these methods, the immersion coating method is usually employed, because a device for use in this method is simple. In these methods, the formation of the photoconductive layer on the conductive support is carried out by applying a coating liquid for the formation of the photoconductive layer onto the conductive support to form a coating film, and then drying this coating film. However, in this formation process, a solvent contained in the coating film is vaporized by the drying, and at this time, an eddy convection is generated in the coating film, so that the surface of the dried coating film becomes uneven and smoothness is lost. This phenomenon is usually called "orange peel".

Heretofore, in order to inhibit the generation of this orange peel, there is known a method in which a solvent having a low vaporization speed is used. However, if this method is particularly used for the drum-like conductive support, the coating film drops during the drying, so that thickness unevenness occurs between top and bottom surfaces of the support. In addition, much time is taken for the drying and productivity also lowers, and for these reasons, the method is not practical. In consequence, this method is unsuitable for the prevention of the orange peel.

In the field of coating materials, a polysiloxane (the so-called silicone oil) is added to a coating material in order to obtain the smoothness on the surface of a coating film. In addition, it is also known that the silicone oil is effective to prevent silking and cratering. Thus, also in the preparation of the electrophotographic photoreceptor, it has been tried to add this silicone oil to the coating solution for the formation of the photoconductive layer, and it has been found that the silicone oil is effective to prevent the orange peel (Japanese Patent Publication Sho 49 No. 15220 and Japanese Patent Application Laid-open Sho 55 No. 140849, Sho 55 No. 5050, Sho 57 No. 212453 and Hei 4 No. 199154). However, these disclosed techniques simultaneously lead to the rise of a residual potential and inconveniently lowers the characteristics of the photosensitive material.

Japanese Patent Application Laid-open Hei 1 No. 234854 discloses an electrophotographic photoreceptor which can be obtained by applying a dispersion comprising a 4,10-dibromoanthanthrone pigment, a polycarbonate and dichloroethane onto a resin intermediate layer to form a charge generation layer, and then further applying there-onto a coating solution comprising the polycarbonate, methylphenylsilicone and 1,2-dichloroethane to form a charge transport layer. The sensitivity of this photoreceptor scarcely deteriorates, but it has a problem that the residual potential largely rises. In consequence, the disclosed photoreceptor is not considered to be satisfactory.

Additionally, in order to obtain the electrophotographic photoreceptor having an excellent surface smoothness without impairing the characteristics of the photoreceptor, it has also be tried that a specific binder resin is combined with a specific polysiloxane to form a photoconductive layer (Japanese Patent Application Laid-open Hei 6 No. 83080 and Hei 6 No. 89038).

SUMMARY OF THE INVENTION

Under such circumstances, an object of the present invention is to provide an electrophotographic photoreceptor which is excellent in surface smoothness and in which the characteristics of the photoreceptor do not deteriorate even when it is repeatedly used.

A first aspect of the present invention is directed to an electrophotographic photoreceptor comprising a conductive support and a photoconductive layer laminated on the conductive support wherein said photoconductive layer contains a charge generation material, a charge transport material, a polyarylate represented by the formula (I)

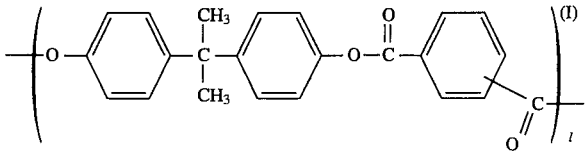

(I)

wherein l represents a polymerization degree of 10 to 5,000, polycarbonate represented by the formula (II)

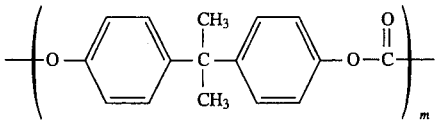

(II)

wherein m represents a polymerization degree of 10 to 5,000, and a polydimethylsiloxane represented by the formula (III)

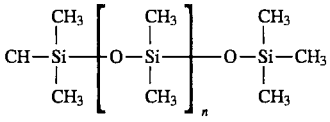

(III)

wherein n represents a polymerization degree of 0 to 2,000.

A second aspect of the present invention is directed to an electrophotographic photoreceptor comprising a conductive support, and a charge generation layer and a charge transport layer laminated on the conductive support wherein said charge transport layer contains a polyarylate represented by the formula (I)

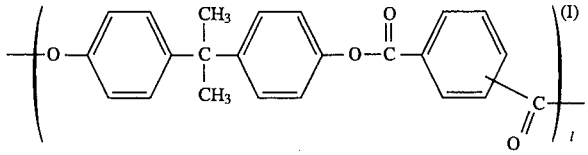

(I)

wherein l represents a polymerization degree of 10 to 5,000, a polycarbonate represented by the formula (II)

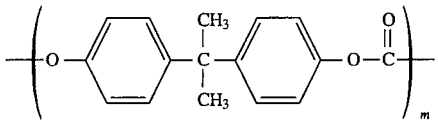

(II)

wherein m represents a polymerization degree of 10 to 5,000, and a polydimethylsiloxane represented by the formula (III)

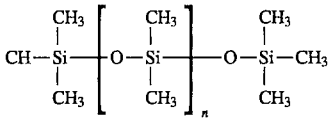

(III)

wherein n represents a polymerization degree of 0 to 2,000.

Further advantages and features of the present invention as well as scope, properties and utilization of the present invention will be apparent from the detailed description of suitable embodiments of the present invention given hereinafter.

DESCRIPTION OF THE PREFERRED EMBODIMENTS

A photoreceptor of the present invention can be basically prepared by the following procedure, but this procedure may be partially different in compliance with the undermentioned constitution of the photoreceptor. That is to say, the photoreceptor can be prepared by dissolving or dispersing a charge generation material and a charge transport material which are photoconductive materials, a polyarylate represented by the formula (I), a polycarbonate represented by the formula (II) and a polydimethylsiloxane represented by the formula (III) in an organic solvent to form a coating solution, applying this coating solution onto a conductive support, and then drying the same to form a photoconductive layer. The electrophotographic photoreceptor of the present invention will be schematically described with reference to FIGS. 1 to 3.

Figure 1:
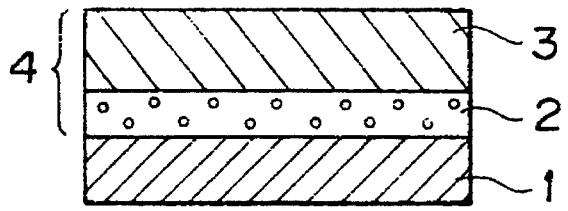
FIG. 1 is a schematic sectional view showing an electrophotographic photoreceptor in which a photoconductive layer is of a function-separated type.

FIG. 1 shows double-layered photoconductive structures in which a photoconductive layer 4 comprising the two layers of a charge generation layer 2 and a charge transport layer 3 is formed on a conductive support 1.

Figure 2:
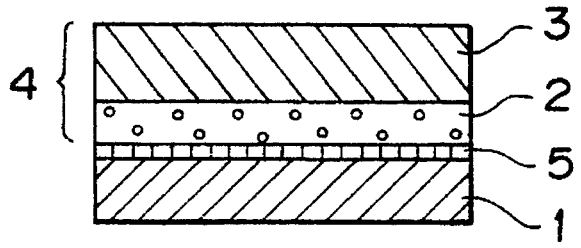
FIG. 2 is a schematic sectional view showing an electrophotographic photoreceptor in which an undercoat layer is formed in the structure shown in FIG. 1.

FIG. 2 shows a photoreceptor in which an undercoat layer 5 is formed between the conductive support 1 and the photoconductive layer 4, and this undercoat layer 5 is provided for the sake of the improvement of coating properties, the improvement of the smoothness of the support, protection from mechanical damage, and the stabilization of electrical properties.

Figure 3:
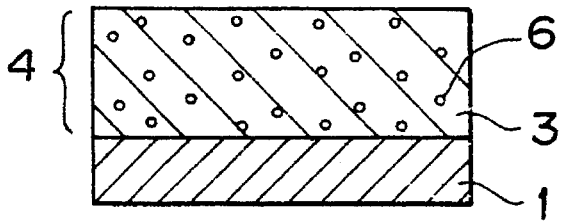
FIG. 3 is a schematic sectional view showing an electrophotographic photoreceptor in which the photoconductive layer is of a single layer type.

FIG. 3 shows a single layer type photoreceptor in which a charge generation material 6 is dispersed in the charge transport layer 3 to form the photoconductive layer 4 on the conductive support 1.

The conductive support in the photoreceptor of the present invention exemplified in FIGS. 1 to 3 must be conductive in itself, and examples of the conductive support include conductive metals such as aluminum, aluminum alloys, copper, zinc, stainless steel, nickel and titanium; a plastic and a paper on which a conductive metal film of aluminum, gold, silver, copper, zinc, nickel, titanium, indium oxide, tin oxide or the like is vapor-deposited; a plastic and a paper containing conductive particles; and a plastic containing a conductive polymer. The support can take a shape of a drum, a sheet, a seamless belt or the like.

Next, the photoconductive layer which is formed on the above-mentioned conductive support will be described with regard to the constitutions of the photoconductive layer in FIGS. 1 to 3.

With regard to the double-layered photoconductive structures, shown in FIG. 1, a charge generation material is contained in the charge generation layer of the photoconductive layer. Examples of the usable charge generation material include inorganic photoconductive materials such as selenium, its alloys, arsenic-selenium, cadmium sulfide, zinc oxide and amorphous silicon; organic pigments such as phthalocyanines, azo compounds, quinacridones, polycyclic quinones and perylenes; and organic dyes such as thiapyrylium salts and squarylium salts. The charge generation material has an absorption in a region of from visible ray to near infrared ray, it absorbs light to generate a carrier, and it is also durable. Among these charge generation materials, the above-mentioned organic pigments are preferable, because the formation of the photoreceptor is easy therefrom and a material having various optional absorption wavelengthes can be selected therefrom. To this charge generation layer, a chemical sensitizer or an optical sensitizer can be added. Examples of the chemical sensitizer include electron-acceptable materials, for example, cyano compounds such as tetracyanoethylene, 7,7,8,8-tetracyanoquinodimethane; quiones such as anthraquinone and p-benzoquinone; nitro compounds such as 2,4,7-trinitrofluorenone and 2,4,5,7-tetranitrofluorenone. Examples of the optical sensitizer include dyestuffs such as xanthene dyestuffs, thiazine dyestuffs and triphenylmethane dyestuffs.

As a method for forming the charge generation layer, there can be used a gaseous phase deposition method such as a vacuum deposition method, sputtering or a chemical vapor deposition method (CVD). Alternatively, the charge generation material is dissolved in a solvent to form a coating solution, or the charge generation material is milled and dispersed in a solvent by means of a ball mill, a sand grinder, a paint shaker or an ultrasonic dispersing machine, and if necessary, a binder resin is added thereto to form a coating solution. The thus formed coating solution may be applied onto the sheet-like support by a Baker applicator, a bar coater, casting or spin coat, or alternatively the coating solution may be applied onto the drum-like support by a spray method, a vertical ring method or an immersion coating method to form the change generation layer.

Examples of the binder resin which can be added, if necessary, for the formation of the charge generation layer include a polyarylate, a polyvinyl butyral, a polycarbonate, a polyester, a polystyrene, a polymethyl methacrylate, a polyvinyl chloride, a phenoxy resin, an epoxy resin and a silicone resin.

Examples of the above-mentioned solvent include ketones such as acetone, methyl ethyl ketone and cyclohexanone; esters such as ethyl acetate and butyl acetate; ethers such as tetrahydrofuran and dioxane; aromatic hydrocarbons such as benzene, toluene and xylene; and aprotic polar solvents such as N,N-dimethylformamide and dimethyl sulfoxide.

The thickness of the charge generation layer is in the range of 0.05 to 5 μm, preferably 0.08 to 1 μm. If the thickness of the charge generation layer is less than 0.05 μm, sensitivity is poor, and if it is more than 5 μm, charging properties deteriorate.

In the charge transport layer which is laminated on the charge generation layer, a charge transport material is contained. Examples of the charge transport material include high-molecular compounds such as polyvinylcarbazole and polysilane; and low-molecular compounds such as hydrazone compounds, pyrazoline compounds, oxadiazole compounds, stilbene compounds, triphenylmethane compounds, triphenylamine compounds, styryl compounds and enamine compounds. These compounds are preferable as the charge transport material, because they have no absorption in a region of from visible ray to near infrared ray, possess a high carrier mobility, and are durable.

The charge transport layer can be formed as follows: The above-mentioned charge transport material is first dissolved in a solvent, and the polyarylate of the formula (I), the polycarbonate of the formula (II) and the polydimethylsiloxane of the formula (III) are then added to the solution to form a coating solution. Next, this coating solution may be applied onto the sheet-like support by means of the Baker applicator, the bar coater, the casting or the spin coat, or alternatively the coating solution may be applied onto the drum-like support by the spray method, the vertical ring method or the immersion coating method to form the charge transport layer on the change generation layer.

The molecular weight of the polydimethylsiloxane is preferably in the range of 200 to 10,000, more preferably 1,000 to 10,000. The amount of the polydimethylsiloxane to be added is preferably in the range of 0.015 or more to less than 2% by weight, more preferably 0.02 to 1% by weight based on the total weight of the binder resin. If the amount of the polydimethylsiloxane is less than 0.015% by weight based on the total weight of the binder resin, any orange peel prevention effect cannot be exerted, and if it is 2% by weight or more based on the total weight of the binder resin, the rise of the residual potential increases.

A ratio of the polyarylate to be mixed is suitably 10% by weight or more based on the total weight of the binder resin. If the amount of the polyarylate to be added is less than 10% by weight based on the total weight of the binder resin, the rise of the residual potential increases. Furthermore, a ratio of the polycarbonate to be mixed is suitably 10% by weight or more based on the total weight of the binder resin. If the amount of the polycarbonate to be added is less than 10% by weight based on the total weight of the binder resin, the drop of the charging properties increases.

With regard to the binder resin for use in the formation of the charge transport layer, there may be added a polyester, a polystyrene, a polymethyl methacrylate, a polyvinyl chloride, a phenoxy resin, an epoxy resin or a silicone resin to the mixture of the above-mentioned polyarylate and polycarbonate.

Examples of the usable solvent include halogen solvents such as dichloromethane and 1,2-dichloroethane; ketones such as acetone, methyl ethyl ketone and cyclohexanone; esters such as ethyl acetate and butyl acetate; ethers such as tetrahydrofuran and dioxane; aromatic hydrocarbons such as benzene, toluene and xylene; and aprotic polar solvents such as N,N-dimethylformamide and dimethyl sulfoxide. If the solvent having a low vaporization speed is used, sag or the like occurs, and hence it is desirable to use a solvent such as dichloromethane, acetone or tetrahydrofuran.

The thickness of the charge transport layer is in the range of 5 to 50 μm, preferably 10 to 40 μm. If the thickness of the charge transport layer is less than 5 μm, the charging properties become poor, and if it is more than 50 μm, it is difficult to form a uniform film.

To the charge generation layer or the charge transport layer, an antioxidant may be added as an additive. Examples of the antioxidant include vitamin E, hydroquinones, hindered amines, hindered phenols, p-phenylenediamines, arylalkanes, derivatives thereof, organic sulfur compounds and organic phosphorus compounds.

The undercoat layer shown in FIG. 2 is provided for the sake of the improvement of coating properties, the improvement of the smoothness of the support, protection from mechanical damage, and the stabilization of electrical properties, and examples of the undercoat layer include polyvinyl alcohol, polyvinyl butyral, casein and N-methoxymethylated nylons. The thickness of the undercoat layer is preferably in the range of 0.2 to 10 μm. If the thickness of the undercoat layer is less than 0.2 μm, the merit of the formation of the undercoat layer cannot be exerted, and if it is more than 10 μm, sensitivity is poor.

The single layer type photoreceptor shown in FIG. 3 comprises the conductive support and the photoconductive layer on the conductive support, and this photoconductive layer is formed by dispersing the above-mentioned charge generation material and charge transport material in the charge transport layer.

This single layer type photoreceptor can be prepared by dissolving or dispersing the above-mentioned charge generation material and charge transport material as well as the binder resin containing the resins represented by the formulae (I), (II) and (III) in the above-mentioned solvent to form a coating solution, applying this coating solution onto the conductive support by the above-mentioned formation method, and then drying the same.

The constitutions of the electrophotographic photoreceptor of the present invention are not limited to the photoreceptors shown in FIGS. 1 to 3, and the present invention covers various other similar constitutions. For example, a surface protective layer may be further formed on the surface of the photoconductive layer.

When the three components of the polyarylate of the formula (I), the polycarbonate of the formula (II) and the polydimethylsiloxane of the formula (III) are contained in the photoconductive layer formed on the conductive support, there can be obtained an electrophotographic photoreceptor which has no orange peel and a smooth surface, can prevent the rise of the residual potential and the drop of the charged potential, and has so an excellent stability as to be repeatedly usable.

EXAMPLES

Next, a photoreceptor of the present invention will be described in more detail with reference to examples and comparative examples, but the scope of the present invention should not be limited to these examples at all.

For the photoreceptors obtained in the examples and the comparative examples, the following evaluations were made.

Measurement of sensitivity:

The sensitivity was measured by a drum evaluation device which was made by the present inventors. That is to say, the sensitivity was evaluated by a reciprocal number of a light energy required until a charged potential had been ½, when irradiation was carried out with a light having 550 nm and 10 $\mu W/cm^2$ separated by an interference filter.

Measurement of charged potential ($V_0$) and residual potential ($V_r$):

An obtained electrophotographic photoreceptor was put on a commercially available copying machine (SF8260; made by Sharp Corporation), and after the confirmation of an image, the charged potentials ($V_0$) and the residual potentials ($V_r$) were measured at an initial stage and after use of 10,000 times as a potential fluctuation at the time of the repeated use.

Measurement of orange peel:

The surface of the photoconductive layer was visually evaluated, and the layer having no orange peel and the layer having the orange peel were evaluated to be o and x, respectively.

In this connection, the sensitivity and the charged potential in Examples 11, 12 and 14 were measured in slightly different manners, and so the measurement procedures will be supplementally described in the examples.

A dimethyl silicone oil (SH200, 50 cs; made by Toray Silicone Co., Ltd.) which can be used in the examples corresponds to polydimethylsiloxane represented by the formula (III).

EXAMPLE 1

(Double-layered photoconductive structures)

2 parts by weight of a polycyclic quinone pigment represented by the formula

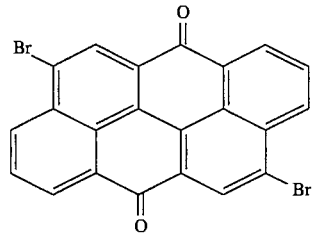

as a charge generation material and 1 part by weight of a phenoxy resin (PKHH; made by Union Carbide Corp.) were dispersed in 97 parts by weight of 1,4-dioxane for 12 hours by a ball mill dispersing machine to prepare a dispersion.

A tank was filled with this dispersion, and a cylindrical aluminum support (aluminum drum) having a diameter of 80 mm and a length of 340 mm was immersed in the tank. Afterward, the support was pulled up, and the thus applied layer on the support was then dried for 1 hour to form a charge generation layer having a thickness of 1 μm.

On the other hand, 100 parts by weight of a hydrazone compound represented by the formula

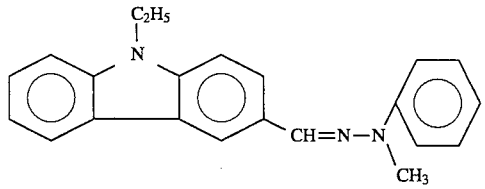

as a charge transport material, 50 parts by weight of a polyarylate (U-100; made by Unitika Ltd.) and 50 parts by weight of a polycarbonate (S-2000; made by Mitsubishi Gas Chemical Company, Inc.) as binder resins, and 0.02 part by weight of a dimethyl silicone oil (SH200, 50 cs; made by Toray Silicone Co., Ltd.) were dissolved in 800 parts by weight of dichloromethane to prepare a coating solution for the formation of a charge transport layer.

Next, by immersion, this coating solution was applied onto the charge generation layer formed on the support, and then dried at 80° C. for 1 hour to form the charge transport layer having a thickness of 20 μm, whereby such double-layered photoconductive structures as shown in FIG. 1 were prepared.

For the thus obtained photoreceptor, the above-mentioned evaluations were made. The results are shown in Table 1.

EXAMPLES 2 to 9

(Double-layered photoconductive structures)

The same procedure as in Example 1 was repeated except that a ratio of a polyarylate to a polycarbonate and the amount of a dimethyl silicone oil were changed as in Table 1, to prepare such a photoreceptor as shown in FIG. 1, and evaluations were then made. The results are shown in Table 1.

Comparative Example 1

(Double-layered photoconductive structures containing no dimethyl silicone oil)

The same procedure as in Example 1 was repeated except that a dimethyl silicone oil was not used, to prepare such a photoreceptor as shown in FIG. 1, and its characteristics were then evaluated. The results are shown in Table 1.

With regard to the photoreceptor, the rise of a residual potential was scarcely observed, but orange peel was seen all over the surface of a photoconductive layer and an obtained image was also in a rough state.

Comparative Example 2

(Double-layered photoconductive structures containing no polyarylate resin)

The same procedure as in Example 1 was repeated except that a polyarylate was not used in a binder resin for a charge transport layer and 100 parts by weight of a polycarbonate (S-2000; made by Mitsubishi Gas Chemical Company, Inc.) and 0.1 part by weight of a dimethyl silicone oil (SH200, 50 cs; made by Toray Silicone Co., Ltd.) were used, to prepare such a photoreceptor as shown in FIG. 1, and its characteristics were then evaluated. The results are shown in Table 1. With regard to the photoreceptor, no orange peel was observed on the surface of a photoconductive layer, and a clear image was obtained, but a residual potential rose when the photoreceptor was repeatedly used.

Comparative Example 3

(Double-layered photoconductive structures containing no polycarbonate resin)

The same procedure as in Example 1 was repeated except that a polycarbonate was not used in a binder resin for a charge transport layer and 100 parts by weight of a polyarylate (U-100; made by Unitika Ltd.) and 0.1 part by weight of a dimethyl silicone oil (SH200, 50 cs; made by Toray Silicone Co., Ltd.) were used, to prepare such a photoreceptor as shown in FIG. 1, and its characteristics were then evaluated. The results are shown in Table 1. With regard to the photoreceptor, no orange peel was observed on the surface of a photoconductive layer, and a clear image was obtained, but a charged potential dropped when the photoreceptor was repeatedly used.

EXAMPLE 10

(Double-layered photoconductive structures)

4 parts by weight of a chlorodiane blue represented by the formula

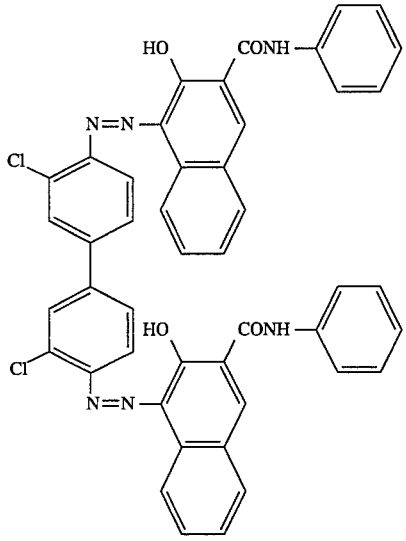

as a charge generation material was dissolved in 257 parts by weight of ethylenediamine, and the solution was then stirred for 45 minutes. Next, 247 parts by weight of n-butylamine was added thereto, followed by stirring for 45 minutes to prepare a coating solution.

A tank was filled with this dispersion, and a cylindrical aluminum support having a diameter of 80 mm and a length of 340 mm was then immersed in the tank. Afterward, the support was pulled up, and the thus applied layer on the support was then dried at room temperature for 1 hour to form a charge generation layer having a thickness of 1 μm.

On the other hand, 100 parts by weight of a hydrazone compound represented by the formula

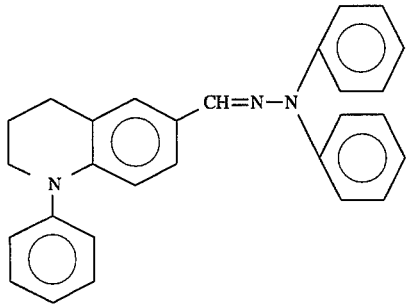

as a charge transport material, 50 parts by weight of a polyarylate (U-100; made by Unitika Ltd.) and 50 parts by weight of a polycarbonate (K-1300; made by Teijin Chemicals Limited) as binder resins, and 0.05 part by weight of a dimethyl silicone oil (SH200, 50 cs; made by Toray Silicone Co., Ltd.) were dissolved in 800 parts by weight of dichloromethane to prepare a coating solution for the formation of a charge transport layer.

By immersion, this coating solution was applied onto the charge generation layer formed on the support and then dried at 80° C. for 1 hour to form the charge transport layer having a thickness of 20 μm, whereby such a photoreceptor as shown in FIG. 1 was prepared. Afterward, evaluations were made, and the results are shown in Table 1.

EXAMPLE 11

(Double-layered photoconductive structures having an undercoat layer)

6 parts by weight of a copolymer nylon (Amilan CM 8000; made by Toray Industries, Inc.) was dissolved in a mixed solvent of 47 parts by weight of methyl alcohol and 47 parts by weight of chloroform, and a tank was filled with this dispersion and a cylindrical aluminum support having a diameter of 30 mm and a length of 255 mm was immersed in the tank. Afterward, the support was pulled up, and the thus applied layer on the support was then dried at 110° C. for 10 minutes to form a undercoat layer having a thickness of about 2 μm.

Next, 2 parts by weight of an X type non-metallic phthalocyanine represented by the formula

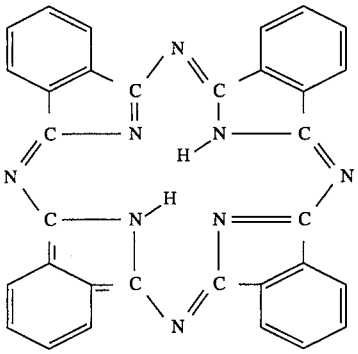

as a charge generation material, 1 part by weight of polyvinyl butyral (Eslec BMS; made by Sekisui Chemical Co., Ltd.) were dispersed in 97 parts by weight of dichloroethane by a ball mill dispersing machine for 12 hours to prepare a dispersion.

A tank was filled with this dispersion, and the above-mentioned cylindrical aluminum support equipped with the undercoat layer was immersed in the tank. Afterward, the support was pulled up, and the thus applied layer on the support was then dried at room temperature for 1 hour to form a charge generation layer having a thickness of 0.2 μm.

On the other hand, 100 parts by weight of a styryl compound represented by the formula

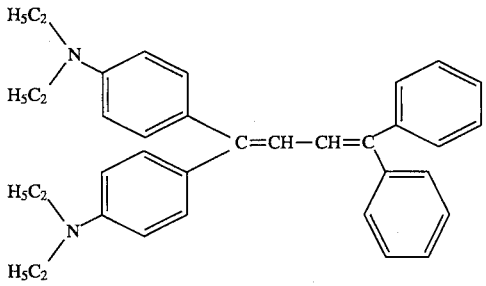

as a charge transport material, 70 parts by weight of a polyarylate (U-100; made by Unitika Ltd.) and 30 parts by weight of a polycarbonate (Novalex 7025A; made by Mitsubishi Chemical Industries, Ltd.) as binder resins, and 0.03 part by weight of a dimethyl silicone oil (SH 200, 50 cs; made by Toray Silicone Co., Ltd.) were dissolved in 800 parts by weight of chloroform to prepare a coating solution for the formation of a charge transport layer.

By immersion, this coating solution was applied onto the charge generation layer formed on the support and then dried at 100° C. for 1 hour to form the charge transport layer having a thickness of 20 μm, whereby such a photoreceptor as shown in FIG. 2 was prepared.

The sensitivity of this photoreceptor was measured in the same manner as in Example 1 except that a drum evaluation device made by the present inventors and a light of 780 nm were used, and the photoreceptor was then put on a commercially available laser beam printer (JX9500; made by Sharp Corporation). After the confirmation of an image, charged potentials ($V_0$) and residual potentials ($V_r$) were measured at an initial stage and after use of 10,000 times as a potential fluctuation at the time of the repeated use. The results are shown in Table 1.

EXAMPLE 12

(A single layer type photoreceptor)

2 parts by weight of a perylene pigment represented by the formula

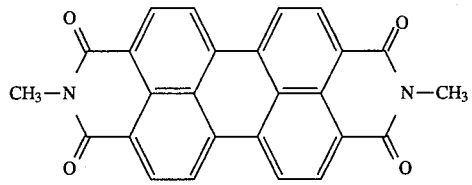

as a charge generation material was dispersed in 98 parts by weight of 1,2-dichloroethane by a paint shaker to prepare a dispersion.

100 parts by weight of a hydrazone compound represented by the formula

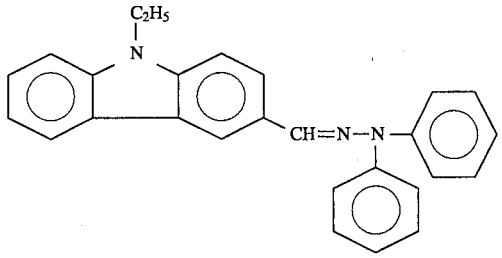

as a charge transport material, 50 parts by weight of a polyarylate (U-100; made by Unitika Ltd.) and 50 parts by weight of a polycarbonate (K-1300; made by Teijin Chemicals Limited) as binder resins, and 0.03 part by weight of a dimethyl silicone oil (SH200, 20 cs; made by Toray Silicone Co., Ltd.) were dissolved in 700 parts by weight of dichloromethane, and the resultant solution was then added to the above-mentioned dispersion to prepare a coating solution for the formation of a photoconductive layer.

By immersion, this coating solution was applied onto a cylindrical aluminum support having a diameter of 80 mm and a length of 340 mm, and then dried at 100° C. for 1 hour to form a photoconductive layer having a thickness of 15 μm, whereby such a single layer type photoreceptor as shown in FIG. 3 was prepared.

The sensitivity of this photoreceptor was measured by the same drum evaluation device as in Example 1 made by the present inventors, and the photoreceptor was then put on a test machine made by remodeling a commercially available copying machine (SF8100; made by Sharp Corporation) into a device for positive charging. After the confirmation of an image, charged potentials ($V_0$) and residual potentials ($V_r$) were measured at an initial stage and after use of 10,000 times as a potential fluctuation at the time of the repeated use. The results are shown in Table 1.

EXAMPLE 13

(Double-layered photoconductive structures)

2 parts by weight of a bisazo pigment represented by the formula

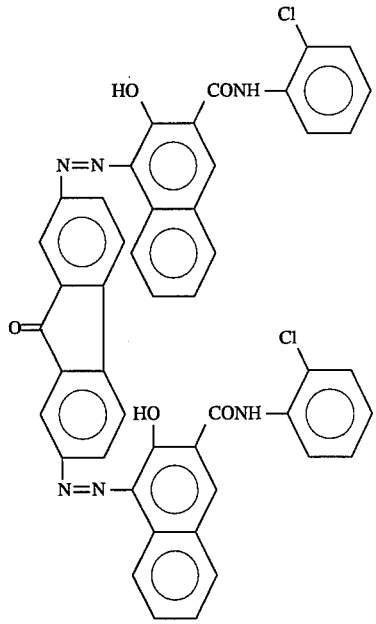

as a charge generation material and 1 part by weight of polyvinyl butyral (XYHL; made by Union Carbide Corp.) were dispersed in 97 parts by weight of cyclohexanone by a ball mill to prepare a dispersion.

A tank was filled with this dispersion, and a cylindrical aluminum support having a diameter of 80 mm and a length of 340 mm was immersed in the tank. Afterward, the support was pulled up, and the thus applied layer on the support was then dried at 110° C. for 10 minutes to form a charge generation layer having a thickness of 0.8 μm.

On the other hand, 100 parts by weight of a hydrazone compound represented by the formula

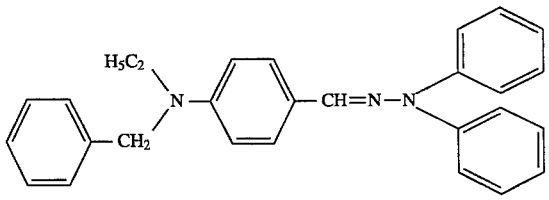

as a charge transport material, 40 parts by weight of a polyarylate (U-100; made by Unitika Ltd.), 40 parts by weight of a polycarbonate (C-1400; made by Teijin Chemicals Limited) and 20 parts by weight of a polyester resin (V290; made by Toyobo Co., Ltd.) as binder resins, and 0.02 part by weight of a dimethyl silicone oil (SH200, 50 cs; made by Toray Silicone Co., Ltd.) were dissolved in 800 parts by weight of dichloromethane to prepare a coating solution for the formation of a charge transport layer.

By immersion, this coating solution was applied onto the charge generation layer formed on the support, and then dried at 80° C. for 1 hour to form the charge transport layer having a thickness of 20 μm, whereby such a photoreceptor as shown in FIG. 1 was prepared. Afterward, evaluations were carried out by the same procedures as in Example 1. The results are shown in Table 1.

EXAMPLE 14

(Double-layered photoconductive structures)

2 parts by weight of a perylene pigment represented by the formula

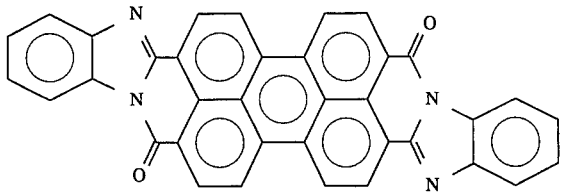

as a charge generation material and 1 part by weight of a phenoxy resin (PKHH; made by Union Carbide Corp.) were dispersed in 97 parts by weight of 1,4-dioxane for 12 hours by a ball mill dispersing machine to prepare a dispersion.

This dispersion was applied, by the use of an applicator, onto a conductive support in which an aluminum layer was formed on the surface of polyethylene terephthalate by a vapor deposition method, and then dried at room temperature to form a charge generation layer having a thickness of 1 μm.

On the other hand, 100 parts by weight of a hydrazone compound represented by the formula

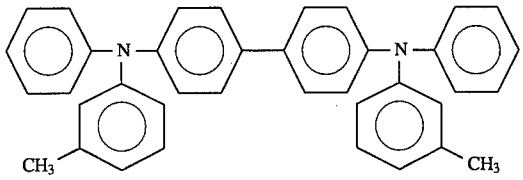

as a charge transport material, 30 parts by weight of a polyarylate (U-100; made by Unitika Ltd.), 30 parts by weight of a polycarbonate (C-1400; made by Teijin Chemicals Limited) and 40 parts by weight of a polyester resin (V-290; made by Toyobo Co., Ltd.) as binder resins, and 0.02 part by weight of a dimethyl silicone oil (SH200, 50 cs; made by Toray Silicone Co., Ltd.) were dissolved in 800 parts by weight of dichloromethane to prepare a coating solution for the formation of a charge transport layer.

Next, by the use of an applicator, this coating solution was applied onto the charge generation layer formed on the support and then dried at 80° C. for 1 hour to form the charge transport layer having a thickness of 20 μm, whereby such a photoreceptor as shown in FIG. 1 was prepared.

This photoreceptor was stuck on a cylindrical aluminum support having a diameter of 80 mm and a length of 340 mm with a conductive tape, and the sensitivity of the photoreceptor was measured by a drum evaluation device made by the present inventors. Afterward, the photoreceptor was then put on a commercially available copying machine (SF8260; made by Sharp Corporation), and after the confirmation of an image, charged potentials ($V_0$) and residual potentials ($V_r$) were measured at an initial stage and after use of 10,000 times as a potential fluctuation at the time of the repeated use. The results are shown in Table 1.

EXAMPLE 15

(Double-layered photoconductive structures having an undercoat layer)

8 parts by weight of titanium oxide (TTO-55(A); made by Ishihara Sangyo Kaisha Ltd.) and 2 parts by weight of a copolymer nylon (Amilan CM 8000; made by Toray Industries, Inc.) were dispersed in a mixture of 45 parts by weight of methyl alcohol and 45 parts by weight of chloroform for 8 hours by a paint shaker to prepare a coating solution for an undercoat layer. A tank was filled with this coating solution, and a cylindrical aluminum support having a diameter of 80 mm and a length of 340 mm was immersed in the tank. Afterward, the support was pulled up, and the thus applied layer on the support was then dried at 110° C. for 10 minutes to form the undercoat layer having a thickness of 1 μm.

Next, 2 parts by weight of a bisazo pigment represented by the formula

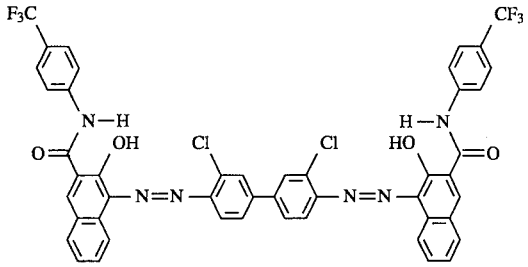

as a charge generation material and 1 part by weight of an epoxy resin (Rikaresin BPO-20E; made by Shin-Nippon Rika Co., Ltd.) were dispersed in 97 parts by weight of dimethoxyethane for 12 hours by a ball mill dispersing machine to prepare a dispersion. A tank was filled with this dispersion, and the above-mentioned cylindrical aluminum support equipped with the undercoat layer was immersed in the tank. Afterward, the support was pulled up, and the thus applied layer on the support was then dried at room temperature for 1 hour to form a charge generation layer having a thickness of 0.2 μm.

On the other hand, 70 parts by weight of a bishydrazone compound represented by the formula

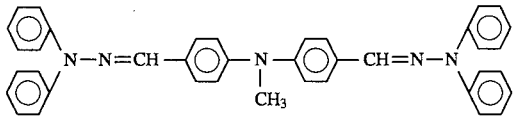

and 30 parts by weight of a hydrazone compound represented by the formula

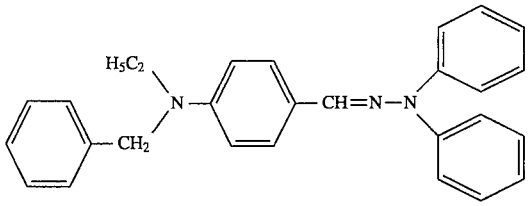

as charge transport materials, 40 parts by weight of a polyarylate (U-100; made by Unitika Ltd.), 40 parts by weight of a polycarbonate (C-1400; made by Teijin Chemicals Limited) and 20 parts by weight of a polyester resin (V-290; made by Toyobo Co., Ltd.) as binder resins, and 0.02 part by weight of a dimethyl silicone oil (SH200, 50 cs; made by Toray Silicone Co., Ltd.) were dissolved in 800 parts by weight of dichloromethane to prepare a coating solution for the formation of a charge transport layer.

By immersion, this coating solution was applied onto the previously formed charge generation layer and then dried at 80° C. for 1 hour to form the charge transport layer having a thickness of 20 μm, whereby such a photoreceptor as shown in FIG. 2 was prepared.

The surface of the obtained photoreceptor was smooth without any orange peel. Afterward, for the obtained photoreceptor, evaluations were carried out, and the results are shown in Table 1.

EXAMPLE 16

(Double-layered photoconductive structures having an undercoat layer)

8 parts by weight of titanium oxide (TA-300; made by Fuji Titanium Co., Ltd.) and 2 parts by weight of a methoxymethylated nylon (EF30T; made by Teikoku Chemicals Co., Ltd.) were dispersed in a mixture of 28 parts by weight of methyl alcohol and 52 parts by weight of 1,2-dichloroethane for 8 hours by a paint shaker to prepare a coating solution for an undercoat layer. A tank was filled with this coating solution, and a cylindrical aluminum support having a diameter of 80 mm and a length of 340 mm was immersed in the tank. Afterward, the support was pulled up, and the thus applied layer on the support was then dried at 110° C. for 10 minutes to form the undercoat layer having a thickness of 1.5 μm.

Next, 2 parts by weight of a bisazo pigment represented by the formula

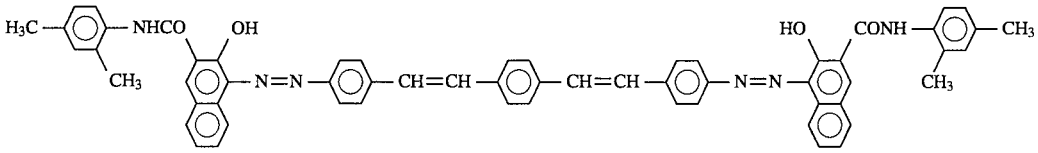

as a charge generation material and 1 part by weight of a phenoxy resin (PKHJ; made by Union Carbide Corp.) were dispersed in 97 parts by weight of 1,4-dioxane for 5 hours by a paint shaker to prepare a dispersion. A tank was filled with this dispersion, and the above-mentioned cylindrical aluminum support equipped with the undercoat layer was immersed in the tank. Afterward, the support was pulled up, and the thus applied layer on the support was then dried at room temperature for 1 hour to form a charge generation layer having a thickness of 0.2 μm.

On the other hand, 90 parts by weight of a bishydrazone compound represented by the formula

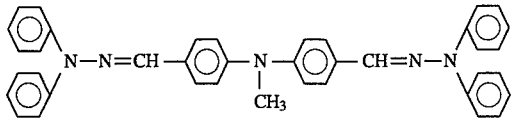

and 10 parts by weight of a hydrazone compound represented by the formula

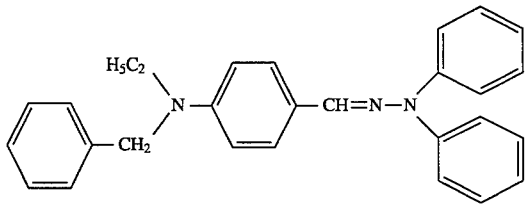

as charge transport materials, 30 parts by weight of a polyarylate (Crystalate A-801; made by Kanegafuchi Chemical Industry Co., Ltd.), 40 parts by weight of a polycarbonate (L-1225; made by Teijin Chemicals Limited) and 30 parts by weight of a polyester resin (V-200; made by Toyobo Co., Ltd.) as binder resins, and 0.02 part by weight of a dimethyl silicone oil (SH200, 100 cs; made by Toray Silicone Co., Ltd.) were dissolved in 800 parts by weight of dichloromethane to prepare a coating solution for the formation of a charge transport layer.

By immersion, this coating solution was applied onto the previously formed charge generation layer and then dried at 80° C. for 1 hour to form the charge transport layer having a thickness of 20 μm, whereby such a photoreceptor as shown in FIG. 2 was prepared.

The surface of the obtained photoreceptor was smooth without any orange peel. Afterward, for the obtained photoreceptor, evaluations were carried out, and the results are shown in Table 1.

EXAMPLE 17

(Double-layered photoconductive structures having an undercoat layer)

8 parts by weight of titanium oxide (TTO-55(A); made by Ishihara Sangyo Kaisha Ltd.) and 2 parts by weight of a methoxymethylated nylon (EF30T; made by Teikoku Chemicals Co., Ltd.) were dispersed in a mixture of 28 parts by weight of methyl alcohol and 52 parts by weight of 1,2-dichloroethane for 8 hours by a paint shaker to prepare a coating solution for an undercoat layer. A tank was filled with this coating solution, and a cylindrical aluminum support having a diameter of 80 mm and a length of 340 mm was immersed in the tank. Afterward, the support was pulled up, and the thus applied layer on the support was then dried at 110° C. for 10 minutes to form the undercoat layer having a thickness of 1 μm.

Next, 2 parts by weight of a bisazo pigment represented by the formula

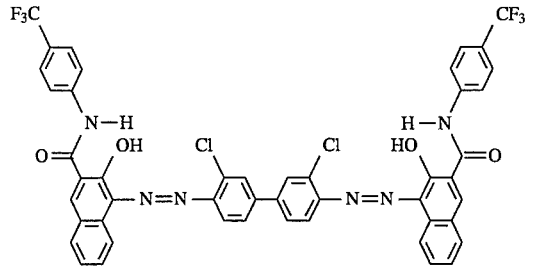

as a charge generation material and 1 part by weight of a phenoxy resin (PKHJ; made by Union Carbide Corp.) were dispersed in 97 parts by weight of tetrahydrofuran for 5 hours by a paint shaker to prepare a dispersion. A tank was filled with this dispersion, and the above-mentioned cylindrical aluminum support equipped with the undercoat layer was immersed in the tank. Afterward, the support was pulled up, and the thus applied layer on the support was then dried at room temperature for 1 hour to form a charge generation layer having a thickness of 0.2 μm.

On the other hand, 100 parts by weight of an enamine compound represented by the formula

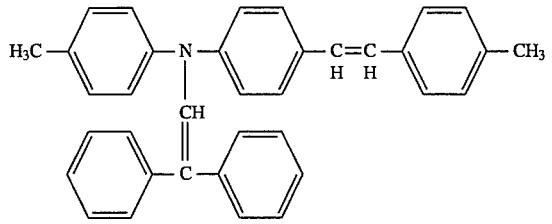

as a charge transport material, 40 parts by weight of a polyarylate (U-100; made by Unitika Ltd.), 40 parts by weight of a polycarbonate (C-1400; made by Teijin Chemicals Limited) and 20 parts by weight of a polyester resin (V-290; made by Toyobo Co., Ltd.) as binder resins, and 0.02 part by weight of a dimethyl silicone oil (SH200, 50 cs; made by Toray Silicone Co., Ltd.) were dissolved in 800 parts by weight of dichloromethane to prepare a coating solution for the formation of a charge transport layer.

By immersion, this coating solution was applied onto the previously formed charge generation layer, and then dried at 80° C. for 1 hour to form the charge transport layer having a thickness of 20 μm, whereby such a photoreceptor as shown in FIG. 2 was prepared.

The surface of the obtained photoreceptor was smooth without any orange peel. Afterward, for the obtained photoreceptor, evaluations were carried out, and the results are shown in Table 1.

EXAMPLE 18

(Double-layered photoconductive structures having an undercoat layer)

8 parts by weight of titanium oxide (TTO-55(A); made by Ishihara Sangyo Kaisha Ltd.) and 2 parts by weight of a methoxymethylated nylon (EF30T; made by Teikoku Chemicals Co., Ltd.) were dispersed in a mixture of 28 parts by weight of methyl alcohol and 52 parts by weight of 1,2-dichloroethane for 8 hours by a paint shaker to prepare a coating solution for an undercoat layer. A tank was filled with this coating solution, and a cylindrical aluminum support having a diameter of 80 mm and a length of 340 mm was immersed in the tank. Afterward, the support was pulled up, and the thus applied layer on the support was then dried at 110° C. for 10 minutes to form the undercoat layer having a thickness of 1.5 μm.

Next, 2 parts by weight of a bisazo pigment represented by the formula

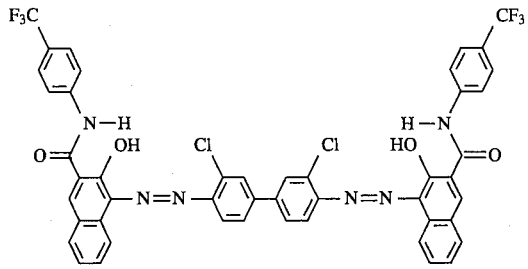

as a charge generation material and 1 part by weight of a phenoxy resin (PKHH; made by Union Carbide Corp.) were dispersed in 97 parts by weight of 1,4-dioxane for 20 hours by a ball mill to prepare a dispersion. A tank was filled with this dispersion, and the above-mentioned cylindrical aluminum support equipped with the undercoat layer was immersed in the tank. Afterward, the support was pulled up, and the thus applied layer on the support was then dried at room temperature for 1 hour to form a charge generation layer having a thickness of 0.3 μm.

On the other hand, 100 parts by weight of an enamine compound represented by the formula

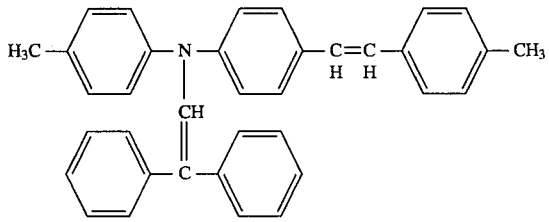

as a charge transport material, 50 parts by weight of a polyarylate (U-100; made by Unitika Ltd.) and 50 parts by weight of a polycarbonate (C-1400; made by Teijin Chemicals Limited) as binder resins, 2 parts by weight of vitamin E (DL-α-tocopherol) and 1 part by weight of a dimethyl silicone oil (SH200, 20 cs; made by Toray Silicone Co., Ltd.) were dissolved in 800 parts by weight of dichloromethane to prepare a coating solution for the formation of a charge transport layer.

By immersion, this coating solution was applied onto the previously formed charge generation layer and then dried at 80° C. for 1 hour to form the charge transport layer having a thickness of 20 μm, whereby such a photoreceptor as shown in FIG. 2 was prepared.

The surface of the obtained photoreceptor was smooth without any orange peel. Afterward, for the obtained photoreceptor, evaluations were carried out, and the results are shown in Table 1.

Comparative Example 4

(Double-layered photoconductive structures)

The same procedure as in Example 1 was repeated except that 0.01 part by weight of a dimethyl silicone oil (SH200, 50 cs; made by Toray Silicone Co., Ltd.) was added, to prepare a sample, and its characteristics were then evaluated. The results are shown in Table 1.

Orange peel was observed all over the surface of the obtained photoreceptor, and an obtained image was also in a rough state. The rise of a residual potential was scarcely observed.

Comparative Example 5

(Double-layered photoconductive structures)

The same procedure as in Example 1 was repeated except that 2 parts by weight of a dimethyl silicone oil (SH200, 50 cs; made by Toray Silicone Co., Ltd.) was added, to prepare a sample, and its characteristics were then evaluated. The results are shown in Table 1.

No orange peel was observed all over the surface of the obtained photoreceptor, and a clear image was obtained. However, a residual potential rose, when the photoreceptor was repeatedly used.

As is apparent from the results shown in Table 1, the photoreceptors containing the three components of a polyarylate, a polycarbonate and a polydimethylsiloxane, i.e., the photoreceptors of Example 1 to 18 have no orange peel and scarcely bring about the rise of a residual potential and the drop of a charged potential. On the contrary, as in Comparative Example 1 to 5, the photoreceptors beyond the scope of the present invention lead to the orange peel, the rise of the residual potential and the drop of the charged potential.

TABLE 1

| | Kinds of Contained Resins and the Like | | |
|---|---|---|---|
| | Poly-acrylate (pts. wt.) | Poly-carbonate (pts. wt.) | Dimethyl Silicone Oil (pts. wt.) |
| Example 1 | 50 | 50 | 0.02 |
| Example 2 | 30 | 70 | 0.02 |
| Example 3 | 10 | 90 | 0.02 |
| Example 4 | 10 | 90 | 0.10 |
| Example 5 | 10 | 90 | 0.20 |
| Example 6 | 70 | 30 | 0.02 |
| Example 7 | 90 | 10 | 0.02 |
| Example 8 | 90 | 10 | 0.10 |
| Example 9 | 90 | 10 | 0.50 |
| Example 10 | 50 | 50 | 0.05 |
| Example 11 | 70 | 30 | 0.02 |
| Example 12 | 50 | 50 | 0.03 |
| Example 13 | 40 | 40 | 0.02 |
| Example 14 | 30 | 30 | 0.02 |
| Example 15 | 40 | 40 | 0.02 |
| Example 16 | 30 | 40 | 0.02 |
| Example 17 | 40 | 40 | 0.02 |
| Example 18 | 50 | 50 | 1.00 |
| Comp. Ex. 1 | 50 | 50 | 0 |
| Comp. Ex. 2 | 0 | 100 | 0.10 |
| Comp. Ex. 3 | 100 | 0 | 0.10 |
| Comp. Ex. 4 | 50 | 50 | 0.01 |
| Comp. Ex. 5 | 50 | 50 | 2.00 |

| | Pre-vention Of Orange Peel | Sensi-tivity ($cm^2$/μJ) | Charged Potential $V_0$ (V) At Initial Stage | Charged Potential $V_0$ (V) After 10,000 times | Residual Potential Vr (V) At Initial Stage | Residual Potential Vr (V) After 10,000 times |
|---|---|---|---|---|---|---|
| Example 1 | o | 1.5 | −710 | −700 | −15 | −25 |
| Example 2 | o | 1.5 | −720 | −710 | −15 | −25 |
| Example 3 | o | 1.5 | −730 | −720 | −20 | −30 |
| Example 4 | o | 1.5 | −730 | −720 | −20 | −30 |
| Example 5 | o | 1.5 | −730 | −720 | −20 | −30 |
| Example 6 | o | 1.5 | −710 | −700 | −15 | −25 |
| Example 7 | o | 1.5 | −700 | −690 | −15 | −20 |
| Example 8 | o | 1.5 | −700 | −690 | −15 | −20 |
| Example 9 | o | 1.5 | −700 | −690 | −15 | −20 |

TABLE 1-continued

| | | | | | | |
|---|---|---|---|---|---|---|
| Example 10 | o | 1.3 | −710 | −705 | −15 | −25 |
| Example 11 | o | 2.6 | −700 | −690 | −20 | −30 |
| Example 12 | o | 0.8 | 710 | 700 | 45 | 55 |
| Example 13 | o | 4.0 | −710 | −700 | −10 | −20 |
| Example 14 | o | 1.1 | −710 | −700 | −40 | −50 |
| Example 15 | o | 2.0 | −700 | −690 | −10 | −20 |
| Example 16 | o | 2.5 | −720 | −710 | −10 | −25 |
| Example 17 | o | 3.0 | −720 | −710 | −10 | −20 |
| Example 18 | o | 3.1 | −720 | −700 | −10 | −20 |
| Comp. Ex. 1 | x | 1.5 | −710 | −700 | −15 | −25 |
| Comp. Ex. 2 | o | 1.5 | −710 | −760 | −15 | −80 |
| Comp. Ex. 3 | o | 1.5 | −700 | −640 | −10 | −15 |
| Comp. Ex. 4 | x | 1.5 | −700 | −685 | −10 | −20 |
| Comp. Ex. 5 | o | 1.5 | −700 | −755 | −10 | −65 |

What is claimed is:

1. An electrophotographic photoreceptor, comprising:

a conductive support; and a photoconductive layer laminated on the conductive support, said photoconductive layer containing a charge generation material, a charge transport material, a polyarylate represented by the formula (I)

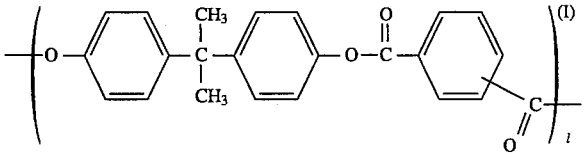

(I)

wherein l represents a polymerization degree of 10 to 5,000, a polycarbonate represented by the formula (II)

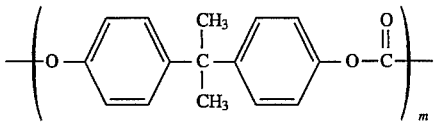

(II)

wherein m represents a polymerization degree of 10 to 5,000, and a polydimethylsiloxane represented by the formula (III)

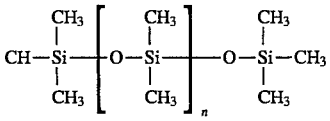

(III)

wherein n represents a polymerization degree of 0 to 2,000.

2. The electrophotographic photoreceptor according to claim 1, wherein an undercoat layer having a thickness of 0.2 to 10 μm is formed between said conductive support and said photoconductive layer.

3. The electrophotographic photoreceptor according to claim 1, wherein said charge generation material is an organic pigment selected from the group consisting of phthalocyanines, azo compounds, quinacridones, polycyclic quinones, perylenes and mixtures thereof.

4. The electrophotographic photoreceptor according to claim 1, wherein said charge transport material is a low-molecular compound selected from the group consisting of hydrazone compounds, pyrazoline compounds, oxadiazole compounds, stilbene compounds, styryl compounds, enamine compounds, triphenylmethane compounds, triphenylamine compounds and mixtures thereof.

5. The electrophotographic photoreceptor according to claim 1, wherein said photoconductive layer contains 10% by weight or more of the polyarylate, 10% by weight or more of the polycarbonate and 0.015 or more to less than 2% by weight of the polydimethylsiloxane based on the total weight of binder resins.

6. An electrophotographic photoreceptor, comprising:

a conductive support; and a charge generation layer and a charge transport layer laminated on the conductive support, said charge transport layer containing a polyarylate represented by the formula (I)

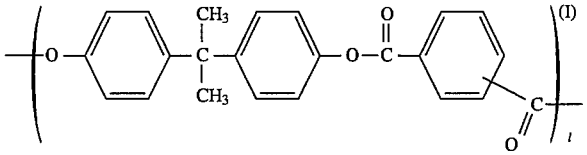

(I)

wherein l represents a polymerization degree of 10 to 5,000, a polycarbonate represented by the formula (II)

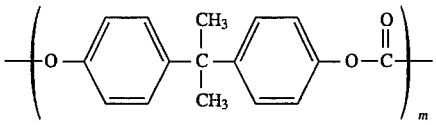

(II)

wherein m represents a polymerization degree of 10 to 5,000, and a polydimethylsiloxane represented by the formula (III)

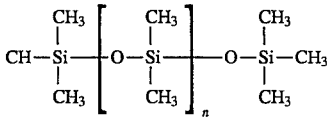

(III)

wherein n represents a polymerization degree of 0 to 2,000.

7. The electrophotographic photoreceptor according to claim 6, wherein the charge generation layer is laminated on the conductive support and further the charge transport layer is laminated on the charge generation layer.

8. The electrophotographic photoreceptor according to claim 6, wherein an undercoat layer having a thickness of 0.2 to 10 μm is formed between said conductive support and said charge generation layer.

9. The electrophotographic photoreceptor according to claim 6, wherein said charge generation layer contains, as a charge generation material, an organic pigment selected from the group consisting of phthalocyanines, azo compounds, quinacridones, polycyclic quinones, perylenes and mixtures thereof.

10. The electrophotographic photoreceptor according to claim 6, wherein said charge transport layer contains, as a charge transport material, a low-molecular compound selected from the group consisting of hydrazone compounds, pyrazoline compounds, oxadiazole compounds, stilbene compounds, styryl compounds, enamine compounds, triphenylmethane compounds, triphenylamine compounds and mixtures thereof.

11. The electrophotographic photoreceptor according to claim 6, wherein the thickness of said charge generation layer is in the range of 0.05 to 5 μm, and that of said charge transport layer is in the range of 5 to 50 μm.

12. The electrophotographic photoreceptor according to claim 6, wherein said charge transport layer contains 10% by weight or more of the polyarylate, 10% by weight or more of the polycarbonate and 0.015 or more to less than 2% by weight of the polydimethylsiloxane based on the total weight of binder resins.

* * * * *